United States Patent [19]

DiFrank

[11] Patent Number: 5,065,565

[45] Date of Patent: Nov. 19, 1991

[54] METHOD AND APPARATUS FOR APPLYING CARRIERS TO CONTAINERS

[75] Inventor: Frank J. DiFrank, Toledo, Ohio

[73] Assignee: Owens-Illinois Plastic Products Inc., Toledo, Ohio

[21] Appl. No.: 419,346

[22] Filed: Oct. 10, 1989

[51] Int. Cl.[5] ..... B65B 21/00

[52] U.S. Cl. ..... 53/398; 53/48.4; 53/556

[58] Field of Search ..... 53/48, 51, 398, 441, 53/556, 582, 585, 580, 48.1, 48.3, 48.4

[56] References Cited

U.S. PATENT DOCUMENTS

| | | | |
|---|---|---|---|
| 3,032,944 | 5/1962 | Hull et al. | 53/48 |
| 3,383,827 | 5/1968 | Schaich | 53/48 |
| 3,706,183 | 12/1972 | Talarico | 53/51 X |
| 3,946,535 | 3/1976 | Bourgeois et al. | 53/48 X |
| 3,959,949 | 6/1976 | Benno et al. | 53/48 X |
| 3,991,640 | 11/1976 | Schlueter | 53/48 X |
| 4,036,362 | 7/1977 | Ullman | 53/398 X |
| 4,079,571 | 3/1978 | Schlueter et al. | 53/48 |
| 4,169,343 | 10/1979 | McArdle | 53/398 |
| 4,324,085 | 4/1982 | Olsen | 53/48 |

*Primary Examiner*—John Sipos
*Assistant Examiner*—Linda Johnson

[57] ABSTRACT

A method and apparatus of applying carriers to arrays of containers, in particular cans, comprising providing a web of interconnected plastic carriers, each carrier having an array of openings for receiving the upper ends of the containers, the configuration of the openings being slightly less than the cross section of the upper ends of the containers, providing a plurality of containers, each container having a bead, a neck and a body portion, moving the cans in a predetermined path, moving the web in a downward converging path with respect to the direction of movement of the containers, engaging the trailing edges of the beads of each transverse row of containers with the trailing edges of a corresponding row of openings in the carrier. While converging occurs, each row of cans is moved relative to its respective row of openings in the carrier to cause the side edges and the leading edge of the row of openings of a carrier to pass over the side edges and the leading edges of the beads of the cans, and successively engaging the trailing edges of succeeding rows of containers with the trailing edges of succeeding rows of openings in the carrier, and thereafter severing the web from the remainder of the web after application to a predetermined number of rows to provide a package having a predetermined array of containers.

This invention relatesto a method and apparatus for a applying carries to containers and a preferably cans.

24 Claims, 9 Drawing Sheets

METHOD AND APPARATUS FOR APPLYING CARRIERS TO CONTAINERS

BACKGROUND AND SUMMARY OF THE INVENTION

In the handling and packaging of containers such as cans, it is common to use a carrier having an array of openings therein for receiving the upper ends of the cans and holding an array of cans to form a container package. Typical United States patents showing such a carrier are U.S. Pat. Nos. 3,874,502, 4,219,117 and 4,586,742.

Such a carrier comprises an interconnected series of bands or rings which are non-circular and which is applied by lateral stretching by machine which inserts fingers into the openings to stretch the openings to a generally circular configuration and then the carrier is forced onto the upper end of the cans below the chime or bead on the cans. During the stretching and application, the bands are folded downwardly along the peripheral surface of the necks of the cans. The resultant package comprises a plurality or array of cans surrounded by the stretch plastic rings.

In pending application Ser. No. 319,775, filed Mar 7, 1989, now U.S. Pat. No. 4,911,290, issued 3/27/90, having a common assignee with the present application, the container package comprises an array of cans and a carrier. The carrier includes a sheet of stiff but flexible plastic material having a plurality of openings forming an array for receiving the ends of the cans and a film of plastic material coextensive with the sheet and bonded to the periphery of the sheet so that it is flat and taut on the sheet. The cans are inserted upwardly into the openings and retained by the carrier by flexing of the periphery of each opening upwardly against the chime or bead of each can. As the cans are inserted, the film is stretched taut over the upper ends of the cans. The film is stretched substantially flat and taut from one peripheral edge to an opposite peripheral edge. The carrier thus protects the cans from contaminants. The carrier supports the array of the cans so that the upper ends of the cans are in a single plane when the package is lifted through finger openings in the film and sheet. The film and sheet define a substantially flat planar upper surface. Indicia such as printing, advertising, logos, artwork and other markings are provided on the film, preferably on the entire surface of the film.

In pending application Ser. No. 385,635, filed July 26, 1989, now U.S. Pat. No. 4,915,217, issued 4/10/90, having a common assignee with the present invention, the container package for cans embodying the invention comprises a sheet of flexible plastic material having a plurality of openings for receiving the upper ends of the cans, the cans extending upwardly through the openings in the sheet with the periphery of the openings flexing upwardly and inwardly beneath the bead of the cans. The modulus of elasticity of the sheet, the thickness of the sheet, and the spacing and size of the openings is such that the bodies of the cans are maintained in abutting relationship, with the plane of the sheet remaining substantially undisturbed and the upper ends of the cans being maintained in substantially the same plane when the package is lifted by engaging the carrier.

Among the objectives of the present invention are to provide a method and apparatus for applying carriers of the types defined in the aforementioned applications Ser. No. 319,775 and Ser. No. 385,635 at high speeds, efficiently and without damaging the carriers or the containers. The disclosure of these applications is incorporated by reference thereto into this application.

In accordance with the invention, the method and apparatus of applying carriers to arrays of containers comprises providing a web of interconnected plastic carriers, each carrier having an array of circular openings for receiving the upper ends of the containers, the diameter of the openings being slightly less than the cross section of the upper ends of the containers. With a plurality of containers, where each container has a bead, a neck and a body portion, the cans are moved in a predetermined path and the web is moved in a converging path with respect to the direction of movement of the containers. The movement of the cans is such that the trailing edges of the beads of each transverse row of containers engages the trailing edges of a corresponding row of openings in a carrier due to the relative movement of each row of cans relative to the respective row of openings in the carrier. Continued convergence will cause the leading and side edges of the row of openings of a carrier to pass over the leading and side edges of the beads of the cans. Likewise, by successively engaging succeeding rows of containers with succeeding rows of openings in the carrier, an array of containers in the carrier is formed, and thereafter severing each carrier from the remainder of the web will provide a package having a predetermined array of containers.

DETAILED DESCRIPTION OF THE DRAWINGS

Figure 1:
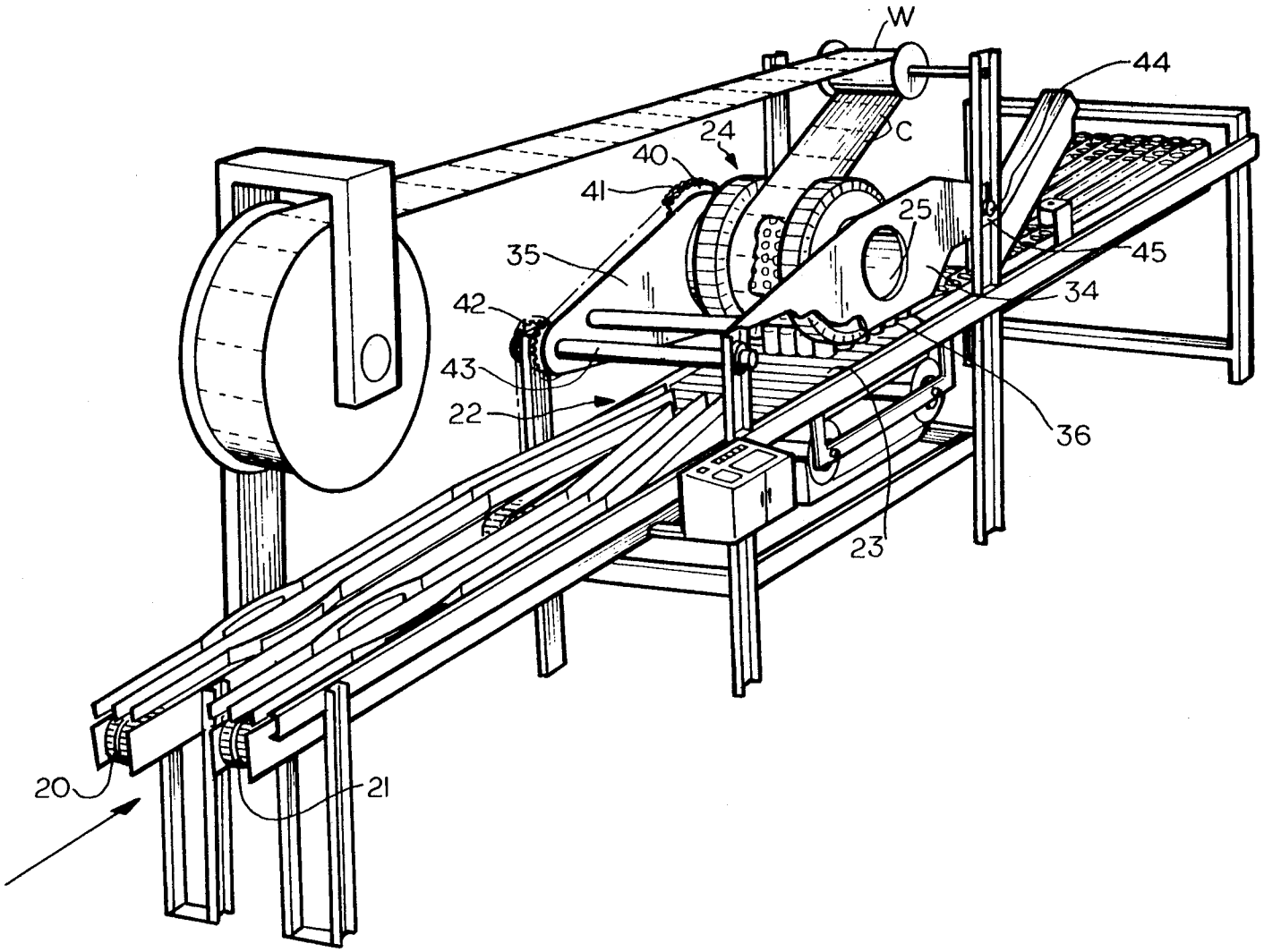
FIG. 1 is a schematic, perspective view of the carrier applicator of the invention including can conveyor.

With particular reference to FIG. 1, the present invention comprises, in the embodiment illustrated, a pair of spaced apart, generally horizontal conveyors 20 and 21 which serve as the infeed conveyor for cans Each conveyor 20 and 21 is composed of a pair of endless belts that are moving to the right, as viewed in FIG. 1, and each will support and move a can along a path that converges to form a row of four cans abreast at the infeed end of a conveyor 22 made up of a plurality of individual, transverse panels 23.

Figure 2:
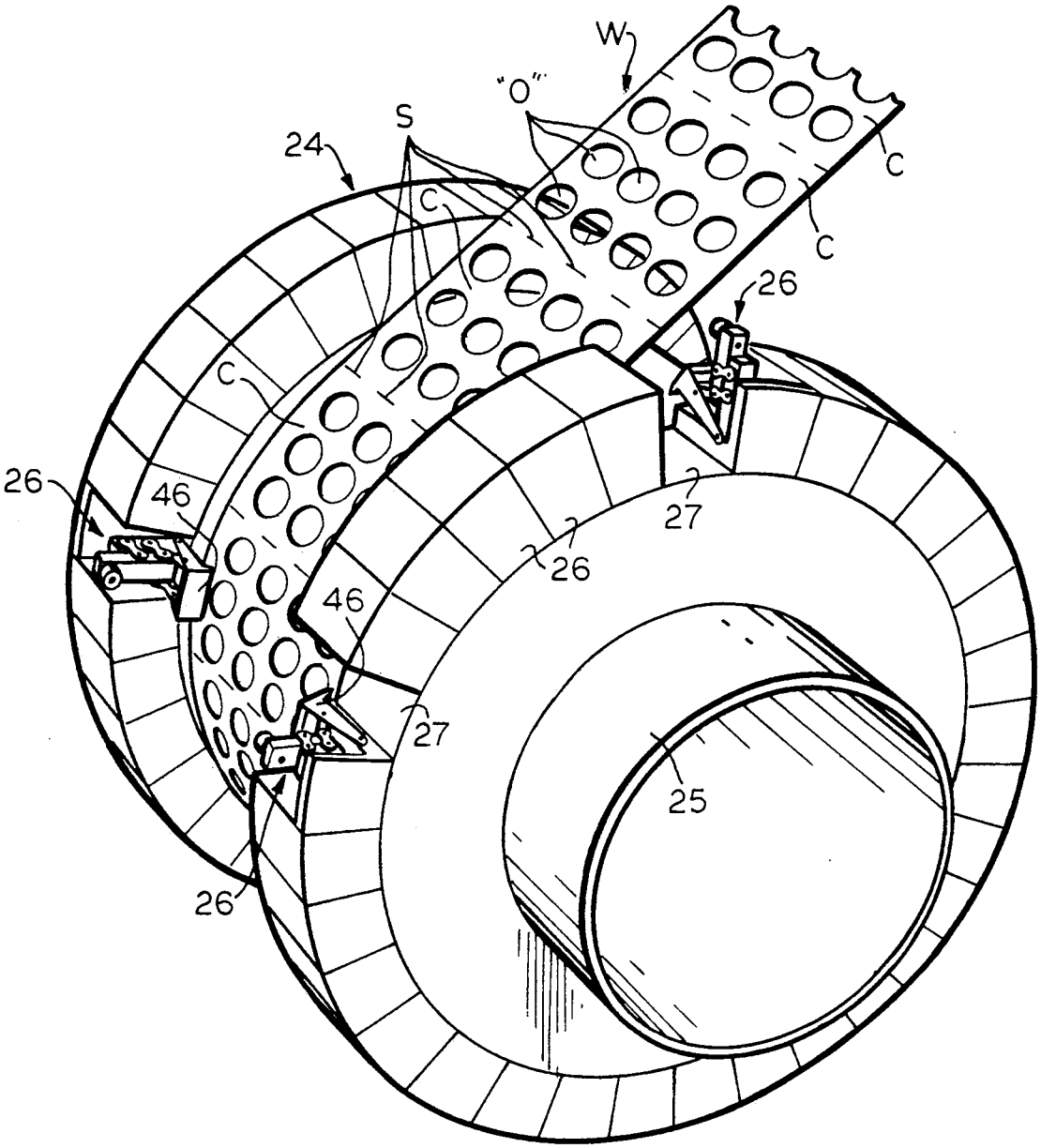
FIG. 2 is a schematic, perspective view of the carrier web supporting wheel of the invention.
Figure 3:
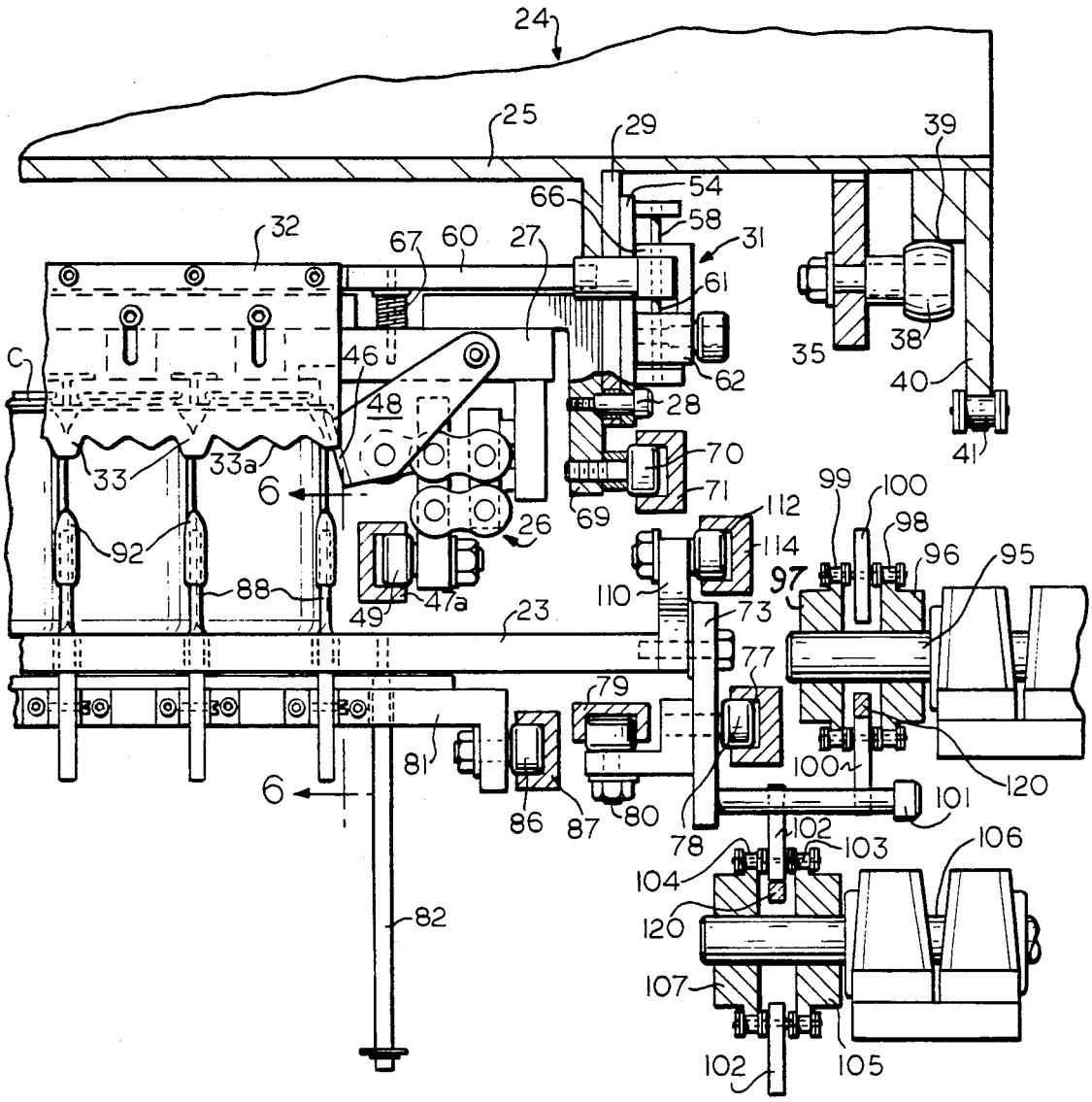
FIG. 3 is a vertical, right half sectional view of the can conveyor and wheel taken at line 3—3 of FIG. 9.
Figure 5:
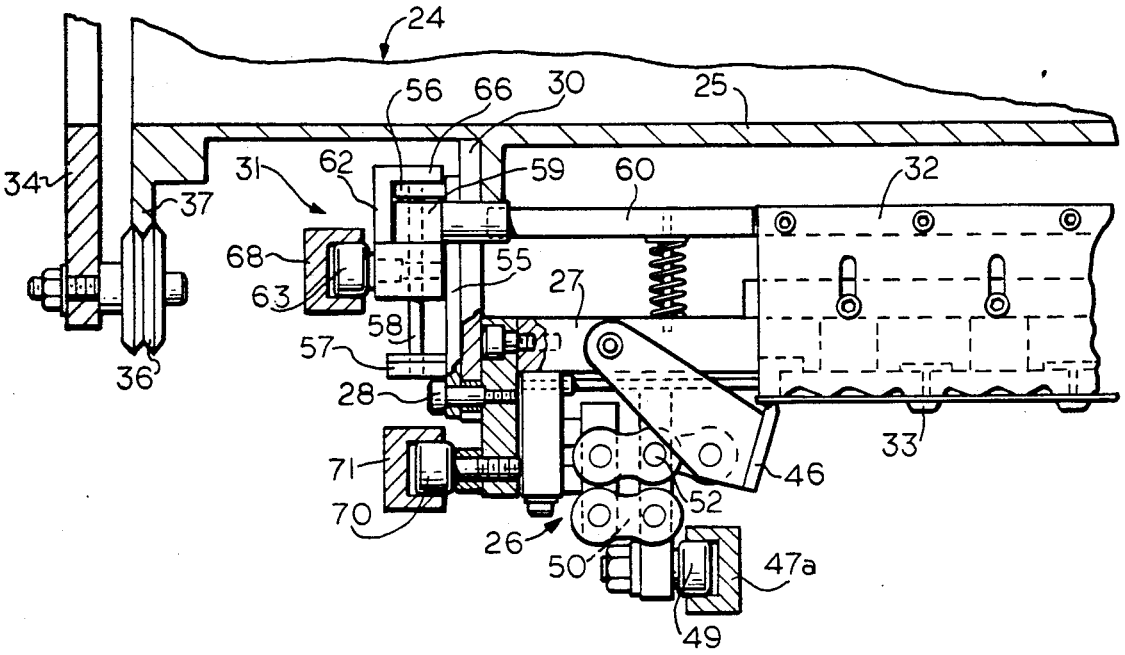
FIG. 5 is a vertical, left half sectional view of the carrier support wheel taken at line 5—5 of FIG. 9.

The conveyor 22 passes beneath an applicator means 24 that supports an endless web "W" of individual carriers "C" that are applied to an array of cans in rows and columns that move beneath the wheel 24. As schematically illustrated in FIG. 2, the means or wheel 24 is in the form of a generally hollow drum 25 which in turn supports a plurality of gripper assemblies 26 that are spaced about the periphery thereof. The gripper assembles 26 are actually mounted radially outward of the surface of the drum 25 on opposite ends of individual wheel panels 27. The wheel panels 27 are mounted for individual pivotal movement about the horizontal axis of mounting pins 28 (FIGS. 3 and 5). The pivot pins 28 are mounted in a pair of radially extending annular plates 29 and 30 that extend out from the surface of the drum 25 to which they are attached.

Figure 9:
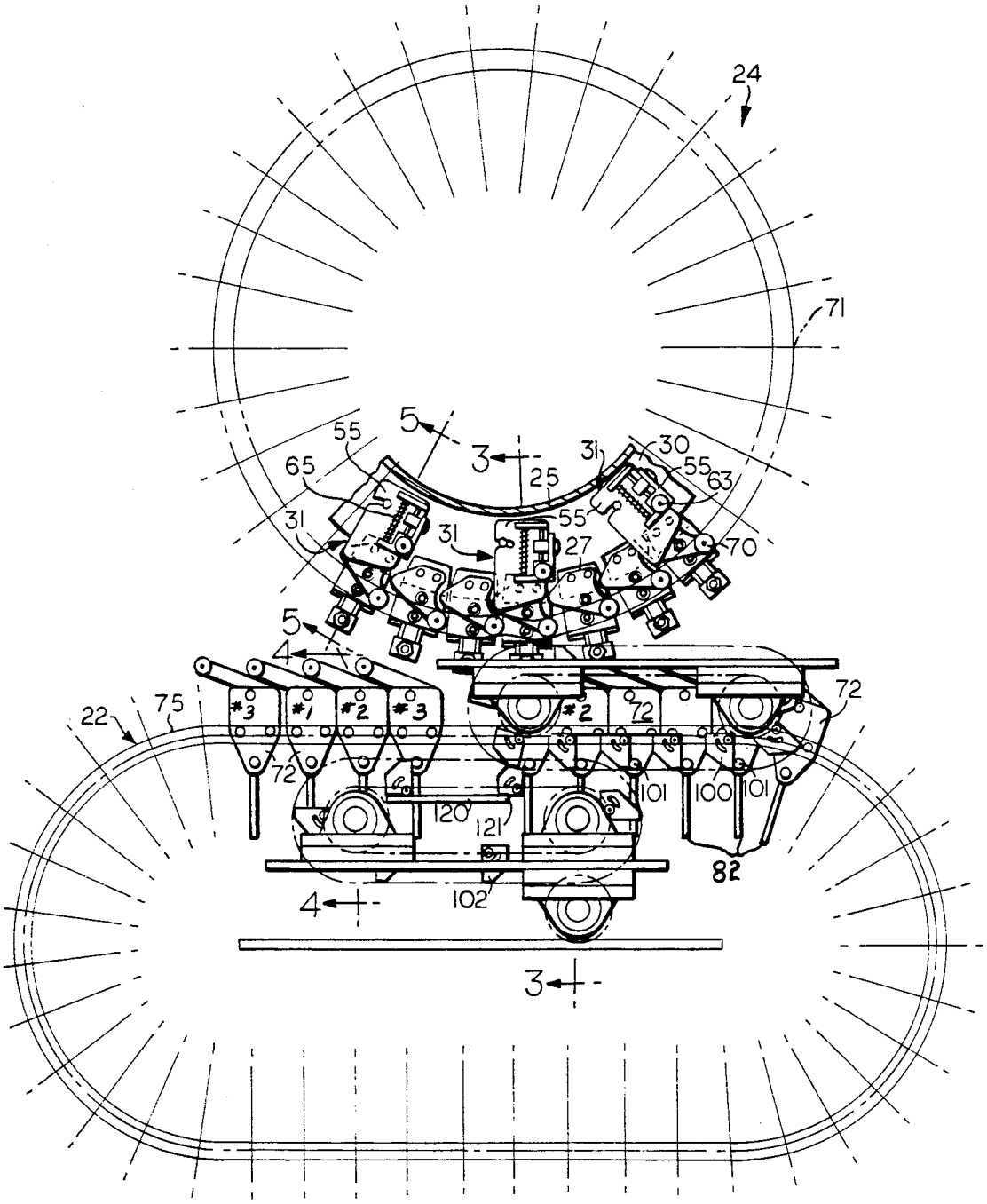
FIG. 9 is a schematic side elevational view of the bottom half wheel and conveyor of FIG. 1.
Figure 10:
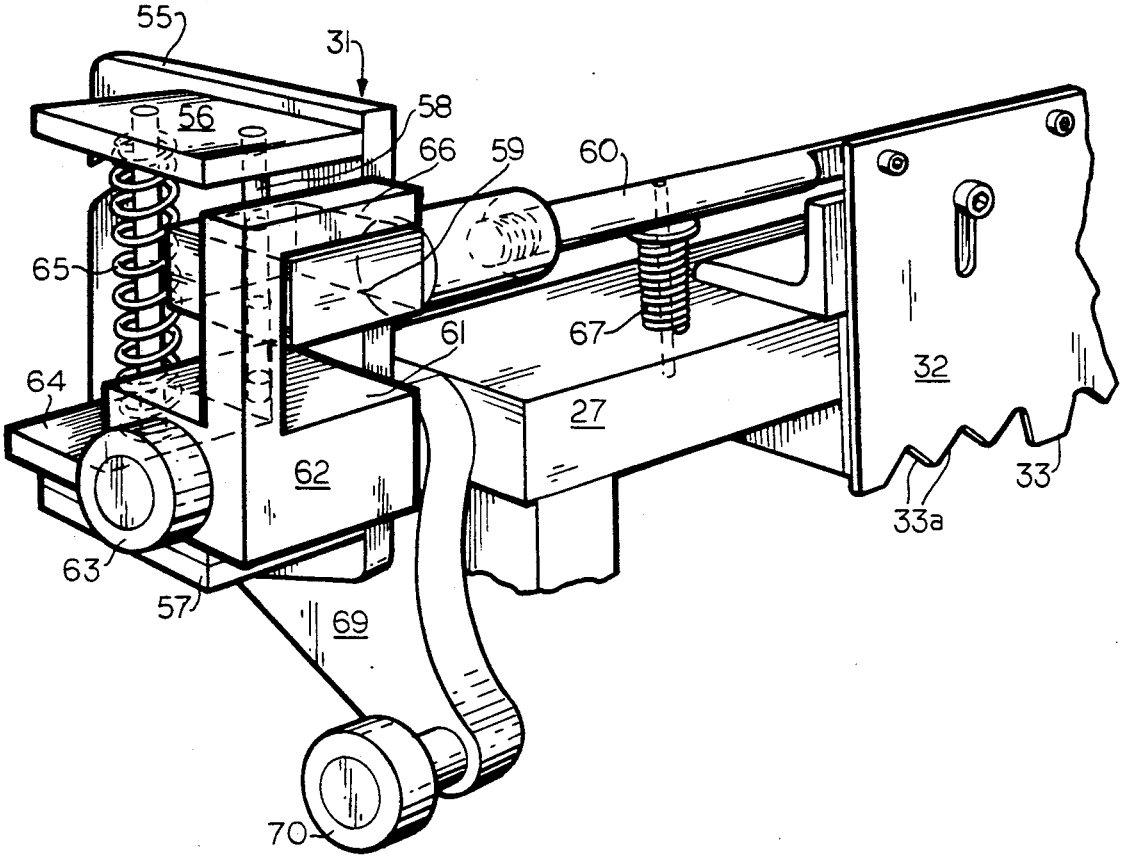
FIG. 10 is a perspective view of one of the web shearing mechanisms carried by the wheel of FIG. 2; and, FIG. 11 is a schematic side elevational view of the can conveyor illustrating the motion of a can past the applicator wheel.
Figure 11:
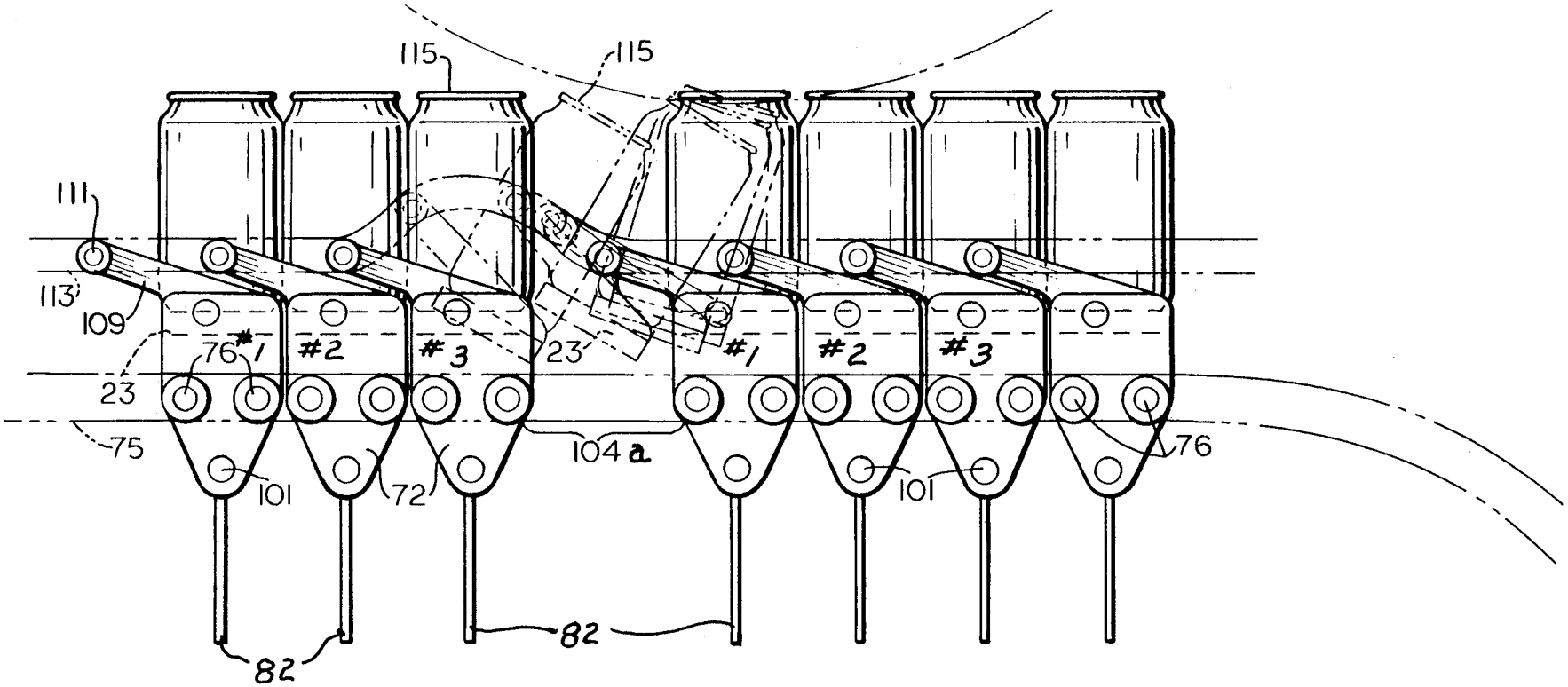

At the juncture of every third wheel panel or bar 27 is located an integral cutting knife and carrier registration mechanism 31 shown in detail in FIGS. 5, 9 and 10. The mechanism 31 includes a knife blade 32 that is provided with smooth edged registration points 33 which extend beyond the cutting edges of the knife blade 32. These registration points 33 are positioned to extend out from the surface of the wheel 24 formed by the bars 27 and are adapted to seek and engage slits "S" in the web "W". The slits "S" are formed in the web at those intervals that define a single carrier and, in effect, define the length of the carrier "C".

As can be seen from FIGS. 1, 3 and 5, the wheel 24 is supported at its ends in a pair of arms 34 and 35. The arm 34 has a series of double beveled wheels 36 in spaced circumferential relationship to the opening therein which cooperate with a bevel edged ring 37 that is fixed to the drum 25. The arm 35, at the opposite end of the drum 25, carries a series of rollers 38 in lower circumferential relationship to the left end of the drum 25. The rollers 38 ride on a circular track 39 which is attached to the drum 25 as is a larger annular drive sprocket 40. The sprocket 40 is engaged by a chain 41 which extends therearound and about a second, smaller sprocket 42 on a drive shaft 43. The drive shaft 43 also serves as a support shaft for one end of the support arms 34 and 35 which are free to rotate relative thereto. The opposite ends of the arms 34 and 35 are connected to a common, horizontal shaft 44 which has its ends supported in fixed cradles 45. Thus it can be seen that the drum 25 is mounted for rotation about a relatively fixed horizontal axis while being supported by the arms 34 and 35.

Each of the panels or bars 27 forming the web supporting surface of the wheel 24 carries a pair of side grippers or clamping assemblies 26 adjacent each end. Basically, the clamping mechanism is designed to be clear of the edges of the web "W" when in retracted position. When the web "W" has engaged the wheel and the knife registration points 33 are engaged in the slits "S" the side clamp mechanism is actuated by engagement with the cam 47*a*. Each of the clamps has a clamping blade 46 mounted at the forward end of a swingable arm 47 carried by side arms 48. Operation of each clamp is under the control of a cam follower 49 which, with reference to the right end of FIG. 3, when raised will cause the parallel linkage 50 to rotate clockwise and raise the arms 48 upward resulting in the blade 46 being clamped against the edge of a jaw piece 51 on the bar 27. Moving the follower 49 down, when in its raised position, will cause the blade 46 to disengage the jaw 51. When the clamping motion occurs, a common pivot 52 between the linkage 50 and arm 47 will pass through dead center and toggle into a locked position. The use of Bellville springs 53 assure that the force exerted through the arm 48 is sufficient to provide a uniform force during the toggling action and a blade gripping force of more than 300 lbs. This force must be adequate to assure that the carrier "C" not slip during application to the cans.

With reference to FIGS. 3, 5, 9 and 10, the operation of knife 32 will be described in greater detail. As explained above, there is a knife mechanism at every third circumferentially spaced wheel panel 27. The blade mounting mechanism includes opposed mounting plates 54 and 55 which are mounted to the outside of the annular plates 29 and 30 by the same mounting pins 28 for the wheel panels 27. A pair of vertically spaced, horizontal plates 56 and 57 extend outwardly from the mounting plates 54 and 55. Extending between the two plates 56 and 57 is a guide rod 58 for guiding a mounting block 59 for the end of a horizontal bar or rod 60 to which the knife blade 32 is mounted. The block 59 which supports the end of the blade mounting bar extends through a vertical gap 61 in a mounting member 62 for a cam follower 63. The member 62 has a horizontal ledge 64 which serves as the bottom anchor for a heavy spring 65. The upper end of the spring bears against the underside of the plate 56. Thus the member 62 is biased in a downward direction by the spring. The member 62 has an arm portion 66 that overlies the mounting block 59 for the bar 60. It should be noted that the gap 61 is normally maintained above the block 59, as shown in FIG. 5, and a compression spring 67 which extends between the wheel panel 27 and bar 60 will hold the bar up except during the cutting period. The cam follower 63 will ride in a cam track 68 and the track will hold the member 62 in the upper position illustrated in FIG. 5. Thus cam track 68 will generally be at the same radial distance from the center of the wheel 24 throughout the circumference of the wheel except at the position illustrated in FIGS. 3 and 10 when the knife is actuated by the spring 65. It should be mentioned that both ends of the knife 32 are similarly mounted and guided by a cam track 68. At the knife position illustrated at the bottom of FIG. 3, the knife has been actuated to cut the carrier and this occurs as the cam follower 63 reaches a vertical drop-off in the cam track. There will be a finite short period as the follower begins to roll off the end of the cam track and enters the period when the blade is driven by the spring 65. During this short period the gap 61 above the block 59 will be closed and the arm 66 will engage the block 59. The "lost-motion" provided by the gap 61 permits this short period of movement of the follower 63 and member 62 to occur without actually moving the blade 32 or its mounting block 59. However, immediately after the follower enters the vertical drop in the cam track, the spring 65 will push the member 62 down with a rapid stroke causing the arm 66 to impact the block 59 and drive the blade 32 through the carrier "C".

The blade 32 has sharp serrated edges 33*a* intermediate the registration points 33 which effectively will cut the carrier material with wedge-like, side-ways cutting action that does not require a very long stroke and thus limiting the movement of the blade to a depth that is less than the height of the can shoulder in the area of the cutting edge of the blade. At the time just prior to the knife blade being actuated, the panel 27 will be tilted in a clockwise direction, as shown in FIG. 9, along with the mounting plates 54 and 55 by the operation of a crank arm 69 that carries a cam follower 70. The cam follower 70 rides in cam track 71 which serves as a "tilt" cam to control the attitude of the panel 27 during a very critical period to assure that the carrier has been fully applied down over the chime of the can and provide a vertical operation of the knife blade and a horizontal attitude for the carrier at the instant of cutting. This is significant if the applicator is to successfully operate at speeds of 2000 cans per minute.

The bars 27, as shown in FIGS. 3, 5, 7 and 8 form a surface over which the carrier web is fed and, to ensure that the carrier web remains taut, during the transport of the web and assembly of the web to the can chimes, it is necessary to clamp the edges of the web with gripper assemblies 26 so that each knife blade 32 with its registration points 33 may extend through a slight gap provided between every third bar 27. The points 33 enter slits "S" in the web and assist in keeping the web in register with the knife blades so that cuts will occur at the proper position to form the carrier and can assemblage. The surface of the bars 27 which face the web are recessed with edges that, in effect, form an upstanding square of slightly greater dimension than the diameter of the can bodies (see FIGS. 7 and 8). This provides room for the edges of the rectangles to actually hold the carrier in a state of tension so that the upper, chimed end of a row of cans can be inserted into holes in the carrier with a motion that simulates the reverse of the motion to extract a can from the carrier. This motion is set forth below in conjunction with the description of FIGS. 3, 4, 10 and 11.

As previously indicated, the cans arrive on incoming conveyors 20 and 21, FIG. 1, and they are guided to form a row containing four cans across the width of the panel conveyor 22. The panels 23 are of a width dimension that essentially equals the diameter of a can. In its operation the conveyor 22 is supplied with enough cans to keep a continuous flow of four cans for each panel and the panels are driven in the direction of the wheel 24 at a fairly constant speed by a mechanism to be described later.

Figure 4:
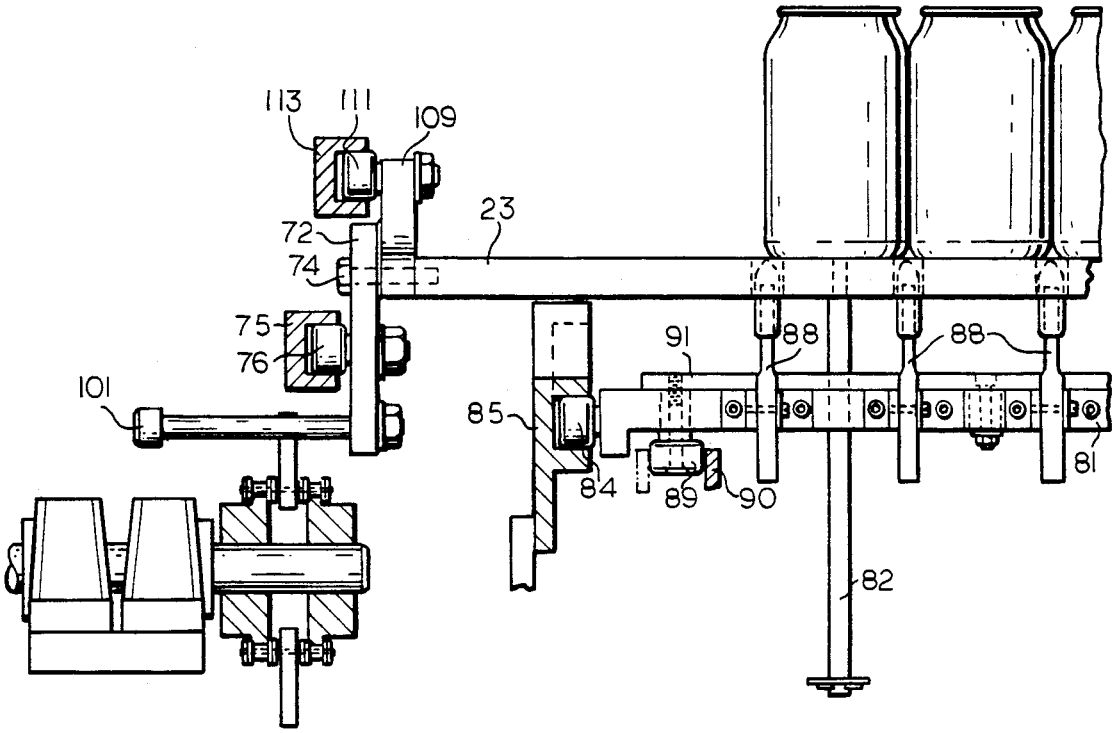
FIG. 4 is a vertical, left half, sectional view of the can conveyor taken, at line 4—4 of FIG. 9.

With reference to the lower half of FIG. 3, the details of the panels 23 of the panel conveyor and the manner in which they are manipulated will be described. The panels 23 are supported at one end by a vertical plate 72 and are supported at the other end by a similar vertical plate 73. The plates 72 and 73 are nominally termed trolleys 72 and 73. The trolleys, as illustrated in FIG. 9, are in side-by-side groups of three with a slight gap provided between groups, this gap being to accommodate the operation of the knife carried by the wheel 24 so that the knife can operate without danger of striking the shoulder of the cans. With reference to FIGS. 3 and 4, the description of a single panel 23 and its supporting system will be given with the understanding that all of the panels are similarly supported and operated. The trolley 72 is bolted at 74 to the left end of panel 23. Below the bolt 74 is a cam track 75 within which a pair of cam followers 76, carried by the trolley 72, rides. At the opposite end of the panel 23 adjacent trolley 73 a cam track 77 is positioned with a pair of cam followers 78 riding therein. The trolleys 72 and 73, with panel 23, are guided in a generally oval, endless path, as shown in sideview FIG. 9. The path is defined by the cam tracks 75 and 77. Supported from beneath the panel 23 is horizontal cam track 79 which guides a cam follower 80 that in turn is bolted to the left side of trolley 73. This cam 79 and follower 80, in effect, keeps the right hand trolley 73 and the entire can conveyor assembly 22 in line beneath the applicator wheel 24.

Figure 6:
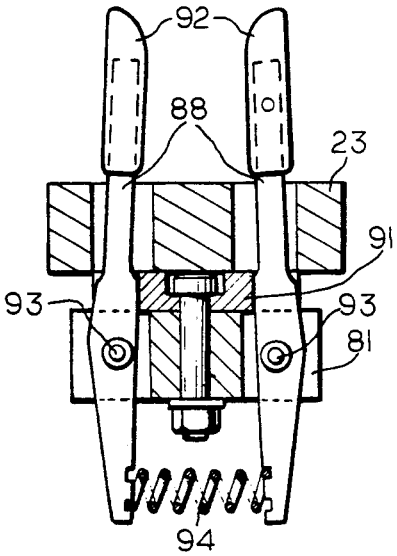
FIG. 6 is an enlarged, sectional view taken at line 6—6 of FIG. 3.

Positioned below each of the panels 23 is a finger bar 81. A pair of vertical pins 82 are connected to the bottom of the panel 23 and extend through holes through the finger bar. The vertical movement of the finger bar 81, is controlled by a cam follower 84 carried by one end of the bar 81 and it rides in a cam track 87. Both cam tracks 85 and 87 are mirror images of each other and function to raise or lower the finger bar 81. The finger bar 81 carries 10 fingers 88 that are initially retracted, with their upper ends in holes in the panel 23 as shown in FIG. 4. When the finger bar is raised, the fingers 88 will be elevated and inserted into the space or open area that is created by the circular contact of the side walls of the cans on the adjacent panels that form a row and columns of cans. There will be sufficient room or space for the insertion of fingers 88 from the next adjacent panel as well. Once the fingers 88 are raised into the position shown in FIG. 3, a cam follower 89 is moved to the left by a cam 90 (FIG. 4) which moves a horizontal slide plate 91 to the left relative to the main portion of the bar 81. As can be seen in FIG. 6, the finger bar 81 pivotally supports the fingers 88 on horizontal axes 93. Below the pivot axis 93, the fingers 88 are biased apart by a spring 94 and the plate 91 has cam faces that permit the fingers 88 of each opposed pair in a panel 23 to be tilted toward each other, as shown in FIG. 6. This results in the upper ends 92 of the fingers gripping a can. In this manner, each individual can becomes locked onto a panel 23 of the can conveyor 22. The raising of the finger bar 81 and locking of the row of cans takes place just prior to the movement of the individual panel 23 through the assembly area beneath the wheel 24, resulting in the necessary can-to-applicator wheel 24 coordination to effect insertion of the cans into the carrier openings.

The drive system for the can conveyor is such that the cans are transported at two different speeds. A standard speed is provided by a drive shaft 95 driving a pair of spaced sprockets 96 and 97 which in turn drive endless chains 98 and 99 (FIG. 3). The chains 98 and 99 both support and drive a series of dogs 100 which are guided in a horizontal path by the movement of the chains to which they are pivotally connected. At the opposite end of the panels 23 a similar chain drive and series of dogs 100 are provided for driving the trolley 72 at the other end of the panel 23. Each series of dogs is for the purpose of driving the pair of spaced apart trolleys 72, 73 associated with each panel 23. As can be seen in FIGS. 3 and 4, there is a single horizontal drive pin 101 extending laterally outwardly from each of the trolleys 72, 73. Since all of the trolleys have pins 101 which the depending dogs 100 will engage, during the drive period, all the trolleys will be pushed along the lower run of the guide cam 75 at the standard speed and brought up to the upper run of the guide cam 75 by the driven dogs 100.

Figure 8:
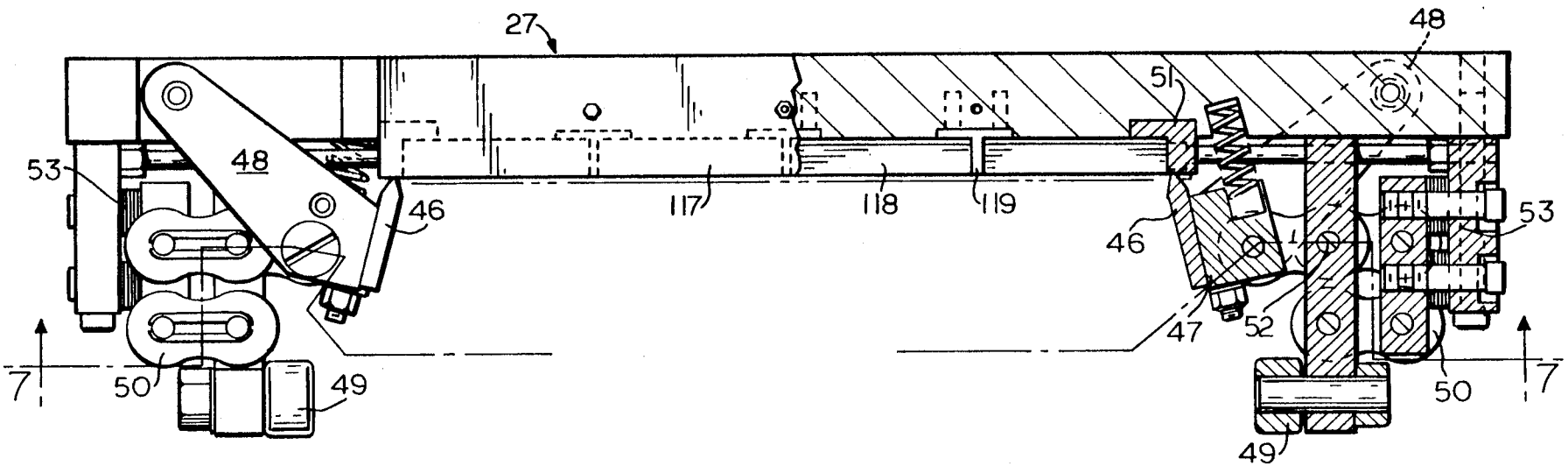
FIG. 8 is a side elevational view and half sectional view of one panel of the web supporting wheel of FIG. 2.
Figure 7:
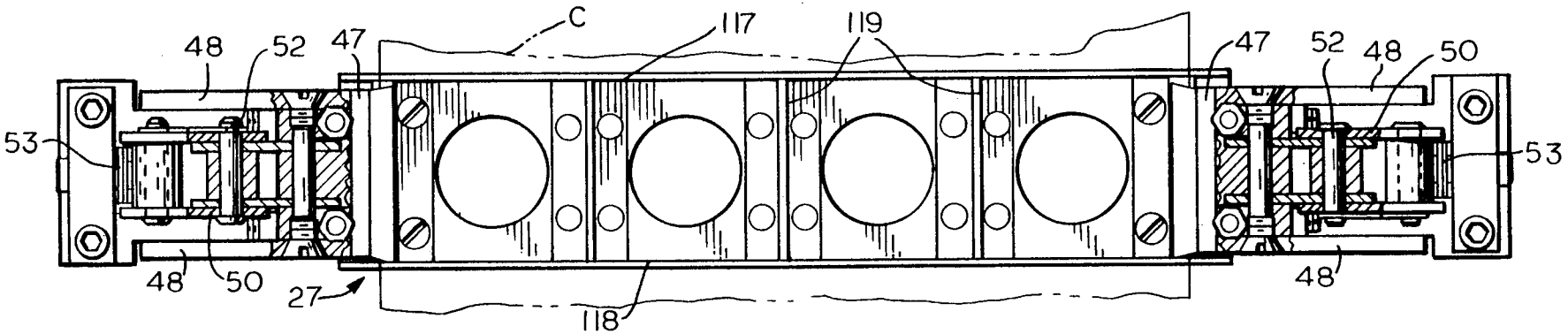
FIG. 7 is a cross-sectional view taken at line 7—7 of FIG. 8.

It should be pointed out that there are actually three pairs of opposed trolleys or panels that operate as a set of three, although each of the pair of trolleys is driven separately through the assembly zone. To distinguish the trolleys of each set they have been numbered 1, 2 and 3 on FIG. 9 and, as previously mentioned, a slight gap is maintained between the number 1 and number 3 trolleys to accommodate the knife. In addition, at approximately the middle of the upper run of the can conveyor, which corresponds to the position of the cans just prior to their underlying the carrier support wheel, a space 104a is provided (see FIG. 11). This space 104a corresponds to the interval in the drive of the trolleys, where they are under the control of a series of drive dogs 102, which are pivotally supported and driven by chains 103 and 104. The chain 103 is in engagement with a drive sprocket 105 mounted on a horizontal drive shaft 106. The shaft 106 carries a drive sprocket 107 that is in engagement with the drive chain 104. While the sprockets 96, 97 and 107, 105 are of the same diameter, they are driven at diverse speeds with the sprockets 107, 105 being driven at approximately twice the velocity of the sprockets 96, 97. In this manner, the can conveyor panel 23 is driven, just prior to passing under the carrier support wheel 24, at twice the linear velocity of the carrier support wheel. At the point in time when the dogs 102 engage the pins 101 that are carried by the trolleys, the supporting panels 23 for the row of cans is rotated about its longitudinal axis through an angle of approximately 30° by the crank arms 109, 110 attached to the panels 23 at their ends. Each arm carries a cam follower 111, 112 which rides in a cam track 113, 114. The crank arm effectively tilts the row of cans that is held on the panel surface forward (see FIG. 11) so that the trailing edges of the chime of the cans will enter the generally circular openings "0" in the carrier "C" as the carrier web "W" is moved over the row of cans. The row of cans moves forward at a velocity that is twice that of the carrier web and the row of cans on the panel 23 are tilted by the cams 113, 114 back to a vertical attitude as they approach the position where they are directly beneath the lowest point in the carrier support wheel. As the row of cans are being tilted back to vertical, the trailing edge 115 of their chime (FIG. 11) will have entered the carrier opening "0" and have impacted against the trailing edge of the opening. The carrier web "W", since it is clamped at its sides to the support wheel, will not move and the stiffness of the web is such that it will not stretch. As the cans are erected, the carrier support wheel moves the web down to overlie the can ends. The wheel panel 27, as shown in FIGS. 7 and 8, has side edges 117 and 118 that extend along the sides and cross bars 119 that will bear against the web in surrounding relationship to the openings therein. By reason of the simultaneous action of the can, having its axis returned to vertical and camming of the carrier opening by the wheel panel 27 being rotated clockwise, the row of cans will have their upper ends cammed or inserted up past the side edges of the openings and the forward edge. The periphery of the carrier openings will surround the can ends in the neck area and bear against the bottom of the can chime.

Additionally, the wheel panel 27 that forms the carrier support wheel periphery is tilted in a clockwise direction by the cams 71, followers 70 and crank arms 69. This clockwise pivotal motion of the bars 27 insures that the leading edge of the opening "0" in the carrier web will be firmly held horizontally as the leading edge of the can chimes are being moved upward as the result of the can panels 23 being turned counter-clockwise into the horizontal and the can axis being brought to vertical.

It should be kept in mind that all of the trolleys 72 and 73 are supported by pairs of followers 76, 78 riding in cam tracks 75, 77 and they are moved only by being engaged with either the dogs 100 of the standard speed drive or the dogs 102 of the high speed drive. The dogs 100 will only engage the pins 101 to drive the trolleys after the high speed dogs 102 have completed their engagement with the pins. The dogs 102 are pivotally connected to the drive chains 103 and 104 and they are held in driving position by a cam plate 120 that extends along the upper run of the chain. The cam plate engages the lower surface of the dogs 102 to keep them in position and when the cam plate ends at 121 the dog will pivot counter-clockwise, at which time the dog 100 on the chain 98 will engage the pin 101 and push the trolleys to the right, as viewed in FIG. 9. The trolleys, in effect, are pushed at the standard speed through essentially their entire circuit except for the period when they are driven by the high speed drive.

As previously explained, the knife 33 is permitted to drop and be spring driven to cut the web at the appropriate time by the cams 68 (FIG. 5). After the web has been cut, which occurs at the position of the section line 3—3 of FIG. 9, the cams 68 will raise the knife and maintain it raised or retracted until the next time it arrives at the cutting position. Each of the plurality of knives is controlled in the same manner as set forth above.

The clamping of the web by the jaws 46 is maintained until the knife has completed its cut, but once the cut is completed and the row of containers has passed the complete insertion position, the clamps 46 are released by the cam followers 49 and cam tracks 47a. The release of the clamps should be completed before the carriers with inserted cans are being raised by the wheel 24 any appreciable amount.

In a like manner, the fingers 88, which are clamping the cans to the individual can support panels 23, will be released by the shifting of the plate 91 to the position seen in FIG. 4, where the fingers are not cammed toward each other, but are essentially vertical. After the cans are inserted in the carrier and they have passed to the right, as viewed in FIGS. 1 and 9, the fingers 88 are returned to vertical and retracted by the cam 84 and track 85. When exiting the assembly area the 12-pack units that are formed may be guided to various lateral positions by a diverter arm to utilize the full width of the outgoing conveyor table shown to the right in FIG. 1.

As can be seen from the foregoing description, the carrier with 12 openings therein is applied to three rows of four cans across for forming a twelve-pack of cans. The apparatus will apply the carriers to the cans regardless of whether the carrier is a single web of plastic material as described in U.S. patent application Ser. No. 385,635, filed July 26, 1989, now U.S. Pat. No. 4,915,217 or the plural layer plastic carrier disclosed in U.S. patent application Ser. No. 319,775, filed Mar. 7, 1989, now U.S. Pat. No. 4,911,290. When the carrier web is formed and the die cuts the openings "O", it will also form the slits "S" that serve as locating holes for the knife that is carried by the applicator means 24. In alignment with the slits, the edges of the web are provided with rounded "V" notches to aid the knife severing.

While the foregoing description is drawn to the application of carriers to form a twelve-pack of containers, it should be apparent that the apparatus may be modified to handle two or three cans per row and that the carriers may be modified so that one, two or more rows between cuts are accepted.

One apparent modification that only requires the addition of a flying knife is one where, after the present apparatus has applied the carrier to 12 cans, the knife slits the carrier in the area between the two center cans resulting in producing a pair of 6-pack packages.

It should be remembered that one of the key considerations in the present invention is that the web of carrier material is clamped along its edges so that can end insertion into the carrier that has essentially circular openings may be accomplished at high speed with absolute assurance and without any pulling or distortion of the plastic sheet carrier in order to insert the can ends.

The use of a two-speed drive system for the can conveyor allows the formation of the necessary space or gap to permit the tilting of the can and high speed movement to allow hooking the can edge into the carrier opening and the return of the can axis to a vertical position with the can end totally inserted in the carrier. The space is necessary to keep the cans from interfering with each other during insertion motion.

Although the invention is described as being for applying a plastic carrier to cans, it is apparent that the apparatus could be used to apply carriers to any generally circular container that has a body portion joined to an upper bead by a sloping shoulder.

What is claimed is:

1. A method of applying carriers to arrays of containers comprising, providing a web of interconnected plastic carriers, each carrier having an array of openings for receiving the upper ends of the array of containers, the configuration of each of the openings being slightly less than the cross section of the upper end of each of the containers, providing a plurality of containers in rows and columns, each container having an upper bead, a neck and a body portion, moving the rows of containers in a predetermined path, moving the web in a converging path with respect to the direction of movement of the containers, first engaging the trailing edges of the beads of each transverse row of containers with the trailing edges of a corresponding row of openings in said carrier web, then causing said row of containers engaged with the trailing edge of said openings to move relative to its respective tow of openings in the carrier to thereby cause the leading edge of said engaged row of openings of said carrier web to pass down over and engage the leading edges of the beads of said engaged containers, successively engaging the trailing edges and leading edges of succeeding rows of containers with the trailing edges and leading edges of succeeding rows of openings in the carrier web thereby applying the carrier to the containers, and thereafter severing each carrier from the remainder of the web to form as a package, a carrier and a predetermined array of containers.

2. The method set forth in claim 1 wherein said step of causing relative movement of each row of containers relative to the respective row of openings in the carrier comprises tilting each row of containers forwardly such that the trailing edge of the bead of each row of containers is in the path of the trailing edge of the row of openings in the carrier and thereafter returning the containers to upright position to cause the leading edge of the row of openings to pass down over the leading edges of the beads of the containers in the row.

3. The method set forth in claim 1 wherein said step of moving said web in a converging path comprises engaging the edges of the web, moving the engaged portions in the converging path, continuing the engagement with the edges of the web until the carrier is applied to the array of containers and thereafter releasing the engagement with the edges of the web.

4. The method set forth in claim 3 including the step of applying a downward force to transverse portions of the carriers about said row of openings successively during the application of the carrier to each row of containers.

5. The method set forth in claim 4 wherein said step of applying force comprises engaging successively the transverse portions of the carriers with a plurality of movable web engaging panels as the web is moved in the converging path.

6. The method set forth in claim 5 wherein the step of moving the panel occurs after the row of openings in the carrier has been engaged with the containers in a row.

7. The method set forth in claim 6 including maintaining engagement of each panel with the carrier web until the array of containers of a previously assembled package is severed from the web.

8. The method set forth in claim 1 including providing transverse slits in the web at the areas of juncture of succeeding carriers, engaging severing knife blades with said slits to register with the carriers, moving the knife blades in the converging path of the carriers to maintain the registry of the carriers, and moving each knife blade transversely after a carrier has been applied to an array of containers to sever the carrier from the remaining web.

9. The method set forth in claim 8 wherein said knife blade comprises a plurality of V-shaped cutting edges adapted to cut the portions of the carrier between the slits when the knife blade is moved transversely relative to the web.

10. The method set forth in claim 9 wherein said web includes "V"-notched edge portions between the carriers which are engaged with a knife edge and are severed by said knife edge when the blade is moved transversely in conjunction with an adjacent knife edge.

11. The apparatus set forth in claim 12 wherein said means for moving said web in a predetermined path with respect to the path of the containers comprises a wheel including means for registering said web on said wheel, a plurality of panels on said wheel for applying pressure about each succeeding transverse row of openings in the web, and wherein said means for severing comprises a plurality of transversely movable knives operable to sever a carrier after it has been applied to an array of containers.

12. An apparatus for applying a carrier to an array of containers comprising, means for moving a web of carriers in a predetermined path, each carrier including transverse rows of openings adapted to engage below the bead on a container having a bead, neck and body, means for engaging and gripping the side edges of the web as it is moved in the predetermined path, means for supporting and moving an array of containers in transverse rows into converging relationship with the path of the web, means for successively tilting the trailing edges of the beads of each row of containers into the path of the trailing edges of the row of openings in a carrier to engage the trailing edges of the beads with the trailing edges of the row of openings and thereafter returning said engaged containers to an upright position to cause the leading edges of the row of openings of a carrier to pass over and below the leading edges of the beads of said engaged containers to engage the leading edges of the beads with the leading edges of the row of openings, and means for severing the web at intervals to form packages.

13. The apparatus set forth in claim 12 wherein said means for moving said web comprises a wheel, and said means for engaging and gripping the side edges of the web comprises clamp means on the wheel adapted to successively engage and disengage portions of the web.

14. The apparatus set forth in claim 13 including a plurality of panels mounted on said wheel, each panel having openings therein greater than the size of the openings in the web for successively applying pressure to the carrier about the openings as the carrier is applied to each row of containers.

15. The apparatus set forth in claim 14 wherein each said panel is mounted for pivotal movement about a trailing edge thereof.

16. The apparatus set forth in claim 15 including a plurality of transversely extending knife blades mounted on said wheel and means for moving each knife blade transversely of the web to sever a carrier from the remainder of the web after the carrier has been applied to an array of containers.

17. The apparatus set forth in claim 16 wherein each said knife blade comprises a plurality of V-shaped knife edges that are adapted to engage slits between the carriers.

18. The apparatus set forth in claim 17 wherein said means for moving said knife blades initially causes them to move into the slits of a carrier and thereby register the carrier as it is moved into position for engagement after which further movement of the knife blade severs the carrier which has been applied to the array of containers from the remainder of the web.

19. The apparatus set forth in claim 18 wherein said knife blade includes inclined edges adapted to engage "V"-notched portions on the side edges of the web between said carriers, said inclined edges being operable upon transverse movement of the knife blade to sever the portion of the carrier between the "V"-notched portions and the adjacent slit in cooperation with the adjacent knife edge.

20. The apparatus set forth in claim 12 wherein said means for tilting each row of containers comprises a plurality of trolleys having container support panels for supporting a row of containers, conveyor means for moving said trolleys in a predetermined path, and means adjacent the area of convergence of the web with& the containers for tilting successively the trolleys and support panels to tilt each row of containers and thereafter returning each trolley to its upright position.

21. The method of forming a package of assembled cans with an overlying sheet of plastic with can end receiving holes comprising, the steps of conveying a plurality of rows of cans in a single direction, moving an assemblage of said plural cans onto a moving articulated can handling system in rows, engaging each can in a row with fingers extending along the sides of the cans, supporting and moving an endless web of plastic having rows and columns of holes therethrough into overlying asymtotic relationship to said assemblage of cans, tilting the axis of each row of cans forward as the row approaches a position under a row of holes in said moving plastic web, returning the can axis to vertical as the rear edge of the chime on the can enters a hole in said web, forcing the web over the remainder of the chime as the row of cans returns to an upright position and the web moves therewith, and severing the full width of said web at preselected intervals after the web has been applied to the cans to form a multiple pack of cans held in rows and columns by said web.

22. The method of claim 21 wherein the step of moving and supporting said web comprises registering the web on the periphery of an overhead rotating drum whose outer surface approaches the top of a line or row of moving cans.

23. Apparatus for applying a web of plastic having an array of can receiving openings to an array of cans comprising, a web supporting wheel formed of a peripheral series of panels, each wheel panel having a width substantially equal to the diameter of the cans, means on each wheel panel for clamping the edges of the web to the ends of the wheel panels, means for rotating said wheel about a horizontal axis, can conveying means extending beneath said wheel, said can conveying means comprising a series of horizontal can support panels having a width substantially equal to the diameter of a can and a length to accommodate a plurality of cans in a row, means movable with each can support panel for engaging and clamping a row of cans to the upper surface of each can support panel, means supporting and guiding said can support panels for movement in a horizontal path beneath said web supporting wheel, a first drive means for moving said can support panels in series at a first speed equal to the speed of the web supporting wheel, second drive means for moving said can support panels at a second, higher speed than said first drive means, said second drive means being effective to move the can support panels at an elevated speed for a finite period prior to the cans, carried on the can support panels, passing beneath the web supporting wheel, and means connected to said can support panels for rotating the panels about a longitudinal axis in a forward direction through an obtuse angle and back to its original attitude during the finite period of high speed movement to thereby cause the upper ends of each row of cans to enter a row of openings in the web supported on said wheel and become locked therein through the combined forward tilt and straightening up of the cans.

24. Apparatus for conveying a plurality of cans in rows along a horizontal path while controllably tilting the vertical axis of the cans forward and back comprising, a plurality of horizontal can panels arranged in an endless series describing an oval path, each can panel supported at its opposite ends by a trolley, a first set of generally oval cam tracks at each end of said panels, cam followers connected to said trolleys and adapted to ride in said cam tracks for guiding the panels in a generally oval path, each can panel being substantially equal in width to the diameter of a can to be handled, a second set of cam tracks at each end of said panels, a single follower in each second cam track and connected by a crank arm to one end of said can panel for rotating the panel through an angle of 20°–40°, a horizontal bar extending parallel to each said can panel, a plurality of vertical gripping fingers supported by said horizontal bar with the upper ends of said fingers extending through vertical holes in said can panel, a third set of cam tracks extending past the ends of said horizontal bars, a cam follower on each end of said bars riding in said cam track for raising the fingers up through the holes in the can panel and means for tilting pairs of said fingers toward each other to grip individual cans at their sides as they are positioned on said can panel.

* * * * *